United States Patent [19]

Porché

[11] Patent Number: 4,629,162

[45] Date of Patent: Dec. 16, 1986

[54] PNEUMATIC INVALID LIFT

[76] Inventor: Albert J. Porché, 4830 Marie, Corpus Christi, Tex. 78411

[21] Appl. No.: 729,953

[22] Filed: May 2, 1985

[51] Int. Cl.[4] ..... B66F 3/24

[52] U.S. Cl. ..... 254/93 HP

[58] Field of Search ..... 254/93 HP, 93 R; 5/81 R; 297/339

[56] References Cited

U.S. PATENT DOCUMENTS

| | | | |
|---|---|---|---|
| 2,644,449 | 7/1953 | Champagne | 254/93 HP |
| 3,346,885 | 10/1967 | Merriman | 254/93 HP |
| 3,819,153 | 6/1974 | Hurst et al. | 254/93 R |
| 3,822,861 | 7/1974 | Scott | 254/93 HP |
| 3,945,610 | 3/1976 | Solie et al. | 254/93 R |
| 3,990,681 | 11/1976 | McKeen | 254/93 HP |

*Primary Examiner*—Robert C. Watson

*Attorney, Agent, or Firm*—Harvey B. Jacobson

[57] ABSTRACT

A pneumatic invalid lift comprises a wedge-shaped inflatable air bag for positioning on a seat surface, and a high volume, low pressure vane-type blower for supplying air to the air bag through a flexible hose connection. Air is discharged from the bag through a small-section outlet nozzle. A remote controlled switch is provided for enabling a person using the air bag to operate the motor whereby the bag is inflated when the motor is running and deflated by exhaust of air through the blower and discharge nozzle when the motor is switched off.

9 Claims, 3 Drawing Figures

PNEUMATIC INVALID LIFT

FIELD OF THE INVENTION

This invention relates to apparatus for use in assisting an invalid or other physically handicapped person in moving from a standing to a seated position and vice versa.

STATEMENT OF PRIOR ART

Applicant is aware of the following U.S. patents, the relevance of which is that they relate to seat structures and powered devices for raising and lowering persons therefrom.

| | | |
|---|---|---|
| U.S. Pat. No. 2,938,570 | Flajole | 5-31-60 |
| U.S. Pat. No. 3,250,569 | Gaffney | 5-10-66 |
| U.S. Pat. No. 3,479,086 | Sheridan | 11-18-69 |
| U.S. Pat. No. 3,479,087 | Burke | 11-18-69 |

Thus, while invalid lift devices are known in the prior art, they tend to be of complex elaborate construction, making them expensive to own or repair.

SUMMARY OF THE INVENTION

The invention provides a pneumatic invalid lift which is of simplified construction, which is readily portable and adaptable to a variety of seats, chairs and the like, so that it can be used at will substantially with any seating surface, and in any environment having a power source, and which can be easily manufactured from readily available non-specialized components.

Accordingly, a pneumatic invalid lift in accordance with the invention comprises an inflatable, preferably single chamber, substantially wedge-shaped air bag for placing on a seating surface, the air bag being substantially absent of external support structure, an air inlet in the bag, an air-bleed outlet nozzle of small cross section in the bag, a source of relatively high volume, low pressure air, for example a high speed vane-type air pump as used on domestic vacuum cleaners, a hose connection between the pump and the air inlet in the bag, and a control switch for operating the pump. The pump may be incorporated in a portable wheeled unit with the control switch on a chord extension for operation by a user when in seated position on the seating surface.

In use, to assist in lowering a physically handicapped person into seated position on a seating surface, the air bag is placed on the seating surface in collapsed condition and inflated by operation of the vane-type pump. When fully inflated the handicapped person backs up against the inflated air bag and terminates the power supply to the pump. The gradual escape of air through the pump and outlet nozzle in the bag gradually deflates the bag thereby gently lowering the user into seated position. To raise the user from seated position, the pump is operated to inflate the bag whereby the user is elevated, with the wedge-shaped form of the bag also supplying a forward thrust. When the bag is fully inflated the pump may be stopped.

The merit of the invention resides, inter alia in its simplified construction compared with the prior art devices, without the need for complex support structure, relief valves or check valves and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
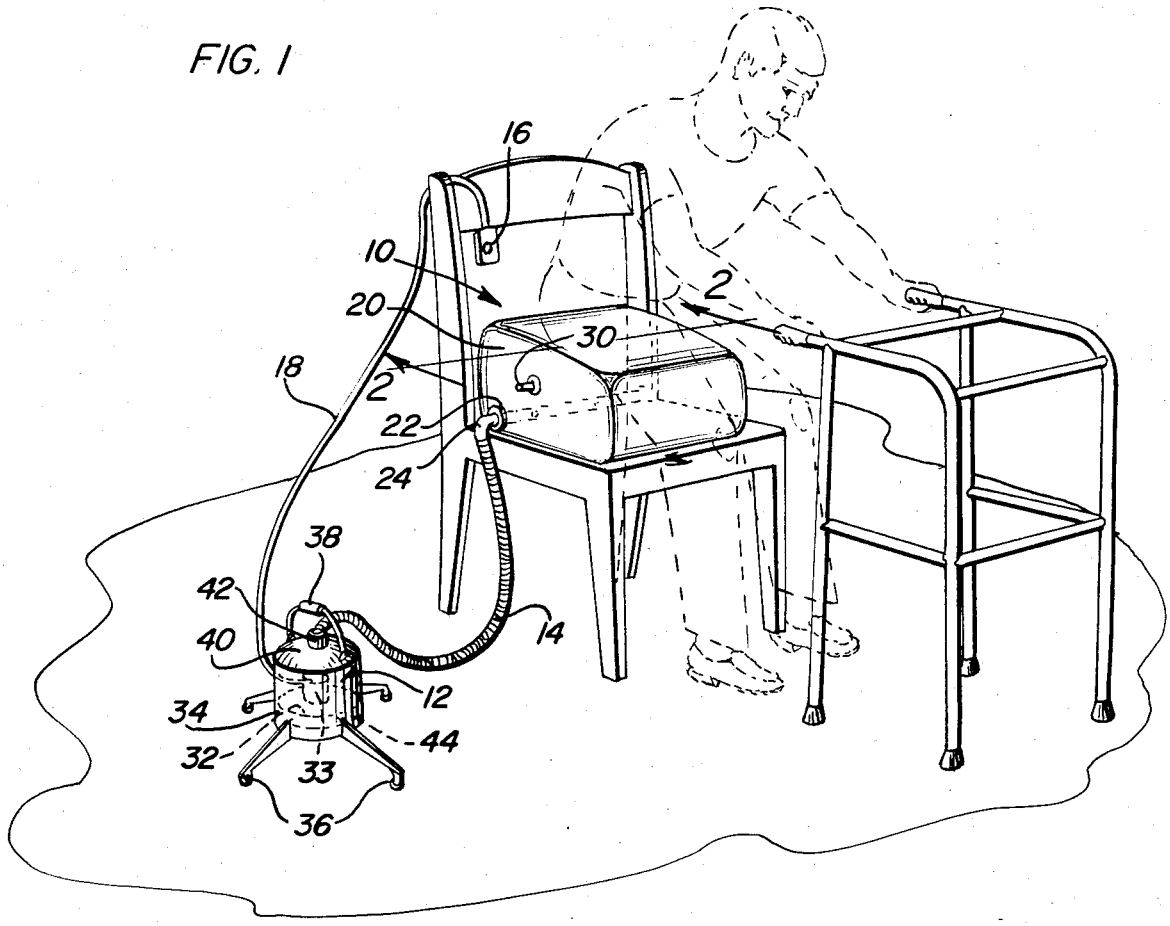
FIG. 1 is a perspective view of a pneumatic invalid lift in accordance with the invention showing its manner of use.
Figure 2:
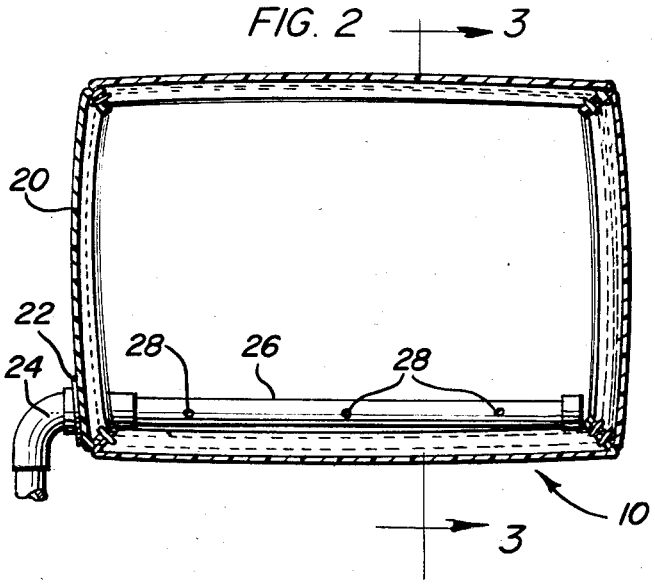
FIG. 2 is an enlarged sectional view on line 2—2 of FIG. 1.
Figure 3:
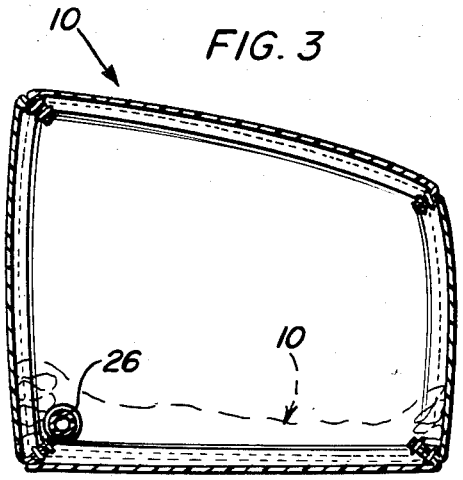
FIG. 3 is a sectional view on line 3—3 of FIG. 2.

The illustrated pneumatic invalid lift comprises an inflatable air bag 10 connected to a pressurized air source 12 by means of a flexible hose 14, and a remote control push button type on-off switch 16 for the air source on a cord 18 extending from the air source.

Air bag 10 may be in the form of a single-chamber or multi-chamber collapsible sac made of 33 mil. vinyl fabric or other suitable material in a substantially wedge-shaped form. For example, when inflated, the bag may have a width of about 18 inches, a depth of about 15 inches front to back, a height at the back of about 13 inches, and a height at the front of about 10 inches. In one side wall 20 of the air bag, there is formed an inlet opening 22 which may be in the form of a cuff-type seal surrounding an elbow-like swivel fitting 24, the outer limb of which connects to hose 14, and the inner limb of which is connected to an air inlet distribution tube 26 extending internally substantially across the width of the air bag. The tube may, for example, be a $\frac{3}{4}$ inch diameter vinyl tube with an open end and three $\frac{1}{4}$ inch outlet orifices 28 evenly spaced along the length of the tube. Tube 26 serves to distribute inlet air substantially evenly across the width of the air bag. Side wall 20 of the air bag is also provided with a permanently open air-bleed outlet nozzle 30 of small diameter for allowing air to exhaust very slowly from the air bag.

Air source 12 may comprise a vane-type blower 32 and electric motor 33 for example as used in domestic vacuum cleaners, suitably housed in a casing 34 on legs 36 with a carrying handle 38. The pressure side of the blower communicates with a plenum 40 having an outlet 42 connected to hose 14, so that when operating, compressed air at about 3 psi is supplied to bag 10. The base of casing 34 may include a screen 44 and a fibre glass air filter which also serves as a sound insulator. A conventional lead and plug (not shown) may be used to connect motor 33 to a 110 volt main power supply. Hose 14 may comprise wire-reinforced vinyl tubing ribbed to increase its flexibility and strength. Casing 34 may be about 12 inches high with a clearance above the floor of about 2 inches.

In use, when a person is to be assisted in moving from a standing to a seated position, the air bag is placed on the seat surface with tube 26 toward the back of the seat, and blower 32 is operated by switch 16 to inflate the bag. This operation may readily be effected by the person being assisted due to switch 16 being on a cord extending from the blower motor. The small amount of air escaping from the bag through nozzle 30 does not unduly effect the bag inflation. When the bag is fully inflated, the person backs up against it, placing his or her weight on the bag, and terminates operation of the blower by releasing switch 16. The air escapes through the blower 32, with a small amount escaping through nozzle 30 so as to allow gradual deflation of the bag gently lowering the person onto the seat.

Conversely, to assist in moving the person from the sitting to the standing position, the deflated bag is simply inflated by actuation of switch 16, and the wedge-shaped form of the bag will cause the person to be raised along with a forward thrust.

It will be understood from the foregoing that the invention provides an invalid lift of greater simplicity and economy than those of the prior art, due to an absence of complex valves, air cushion support structure, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A pneumatic invalid lift comprising an inflatable air bag for placing on a seating surface, an air inlet in the bag, a small-section air bleed nozzle in the bag for permitting slow escape of air from the bag, a portable blower for the supply of relatively high volume, low-pressure compressed air, a hose connection between the blower outlet and said air inlet, and control means for operating the blower so as to selectably supply compressed air to the bag through said inlet whereby the bag is inflated and to terminate the supply of compressed air to the bag whereby the bag is gradually deflated by escape of air through the blower and through said nozzle, wherein the air inlet to the bag includes a fitting extending through an opening in a side wall of the bag, and an air distributor tube extending from said fitting along the bag interior adjacent a rear wall thereof for distributing incoming air substantially uniformly through the width of the bag.

2. The invention of claim 1 wherein the fitting comprises a swivel fitting.

3. The invention of claim 1 wherein the rear wall of the bag is higher than a front wall of the bag giving the bag a wedge-shaped form useful in providing a forward thrust to a user when a elevating the user from a seated toward a standing position by inflation of the bag.

4. The invention of claim 3 wherein the bag is of single-compartment construction and made of 33 mil. thick fabric.

5. The invention of claim 1 wherein the blower is an electric motor-driven vacuum cleaner-type rotary-vane air pump.

6. The invention of claim 5 wherein the pump and motor are contained in a portable casing on legs and defining an outlet plenum from which the hose extends.

7. The invention of claim 5 wherein the control means comprises a momentary on-off switch for the pump motor, the switch being carried on a remote control cable extending from the motor so that it may be operated by a person using the air bag to assist in moving him or herself as between standing and sitting positions.

8. A pneumatic invalid lift comprising a wedge-shaped inflatable air bag for placing on a seating surface, the air bag having a back wall which is higher than a front wall of the bag, an air inlet in a side wall of the bag, an air distribution tube extending internally of the bag from the inlet adjacent the rear wall and substantially across the width of the bag, discharge means in the tube for distributing incoming air substantially uniformly across the width of the bag, an air-bleed nozzle in the bag for permitting the slow escape of air from the bag, a portable casing including a motor driven vane-type blower for providing low-pressure high volume compressed air to the bag, a flexible hose connection between a blower outlet in the casing and the bag inlet, and a remote control push-button switch for the motor whereby the bag may be inflated by pushing the switch which operates the motor and may be deflated by releasing the switch allowing escape of air through said nozzle and said blower upon termination of operation of the motor.

9. The invention of claim 1 wherein the air bleed nozzle is a permanently open nozzle.

* * * * *